US005573247A

United States Patent [19]

Ridge

[11] Patent Number: 5,573,247

[45] Date of Patent: Nov. 12, 1996

[54] PUTTING GAME

[75] Inventor: William Ridge, Elizabethtown, Ky.

[73] Assignee: Club Pro Products, Inc., Louisville, Ky.

[21] Appl. No.: 534,054

[22] Filed: Sep. 26, 1995

[51] Int. Cl.[6] ..... A63B 69/36

[52] U.S. Cl. ..... 473/184; 273/271

[58] Field of Search ..... 273/180, 178 R, 273/178 A, 178 B, 271; 473/184, 182, 183

[56] References Cited

U.S. PATENT DOCUMENTS

| | | | |
|---|---|---|---|
| 1,094,236 | 4/1914 | Minshall | 273/178 R |
| 1,656,739 | 1/1928 | Kurtz | 273/180 |
| 2,704,212 | 5/1952 | Dunseith . | |
| 2,788,974 | 4/1957 | Pick | 273/271 X |
| 2,967,714 | 1/1961 | Calabrese | 273/271 |
| 4,275,886 | 6/1981 | Bannon . | |
| 5,120,063 | 6/1992 | Birchler et al. . | |
| 5,131,658 | 7/1992 | Grenon | 273/180 |
| 5,275,405 | 1/1994 | Ridge . | |
| 5,431,403 | 7/1995 | Pelz | 273/178 B |

*Primary Examiner*—George J. Marlo
*Attorney, Agent, or Firm*—Wheat, Camoriano, Smith & Beres, PLC

[57] ABSTRACT

A golf putting game frame includes indentations in the frame for storing the golf balls.

6 Claims, 4 Drawing Sheets

PUTTING GAME

BACKGROUND OF THE INVENTION

The present invention relates to golf, and, in particular, to a golf putting game.

Golfers like to practice their putting even when they are not on the golf course. Some putting games are already known, such as those shown in U.S. Pat. No. 2,704,212 "Dunseith", U.S. Pat. No. 4,275,886 "Bannon", and U.S. Pat No. 5,275,405 "Ridge".

SUMMARY OF THE INVENTION

The present invention provides a putting game which uses the skills a golfer needs on the golf course while being interesting and challenging.

The present invention provides a putting game for playing a golfer's version of tic-tac-toe, with each player having a separate set of balls and with separate indentations on the game frame for storing the sets of balls.

The present invention also provides a flat surface at each of the back corners so balls do not get stuck in a dead space on the board.

DESCRIPTION OF THE PREFERRED EMBODIMENT

Figure 1:
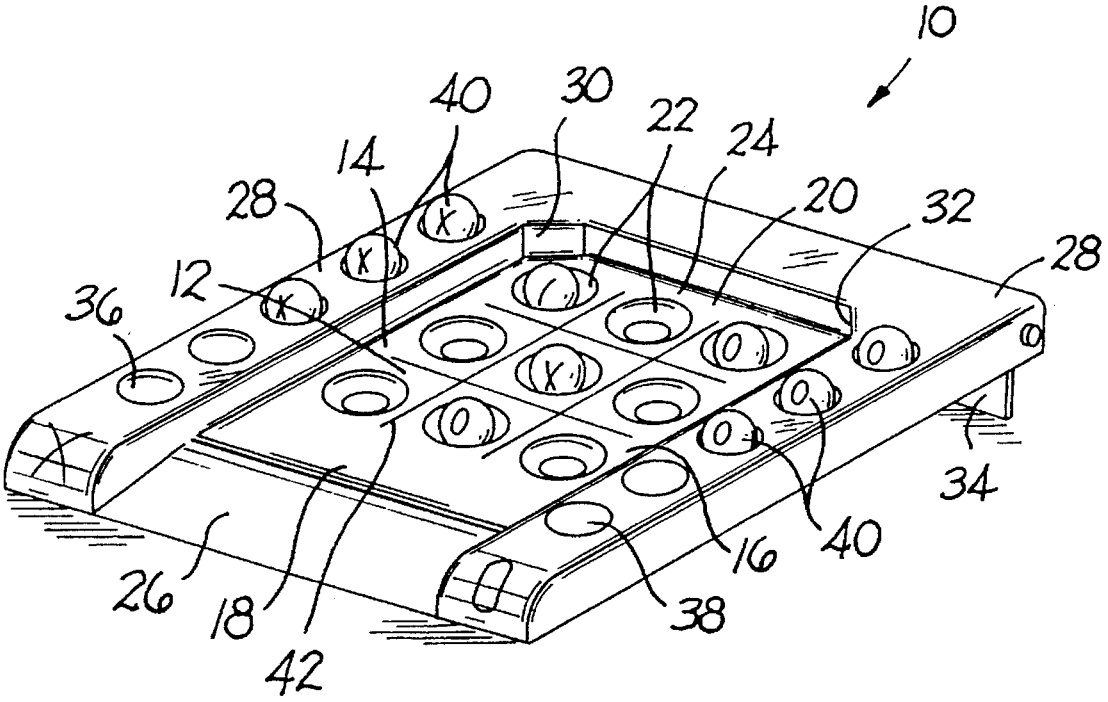
FIG. 1 is a perspective view of the putting game device of the present invention.
Figure 2:
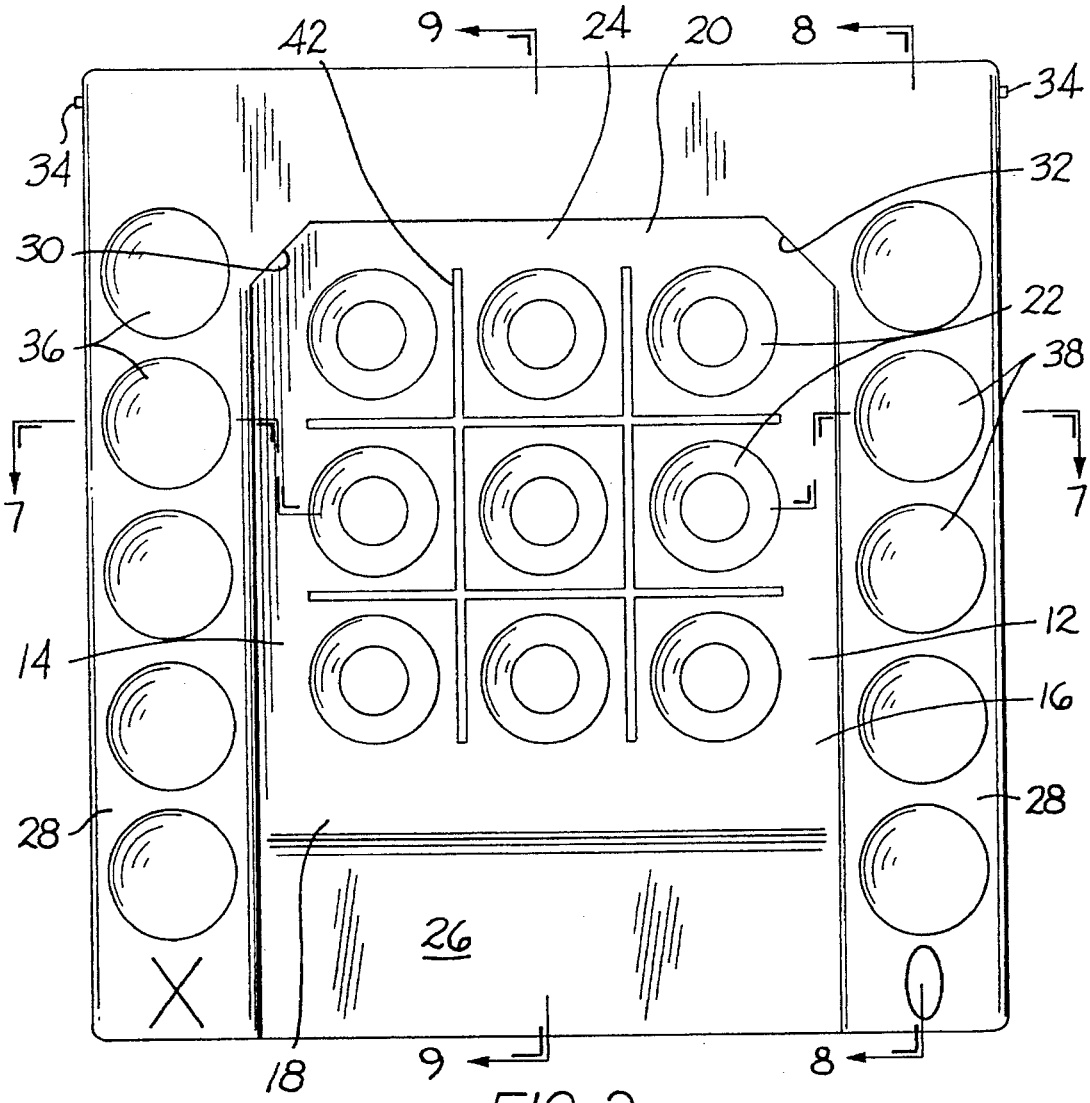
FIG. 2 as a top plan view of the putting game device of FIG. 1.
Figure 3:
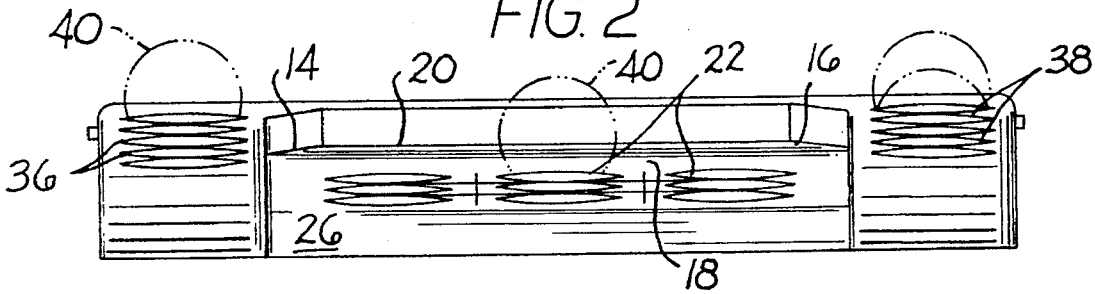
FIG. 3 is a front view of the putting game device of FIG. 1, with golf balls shown in phantom.
Figure 4:
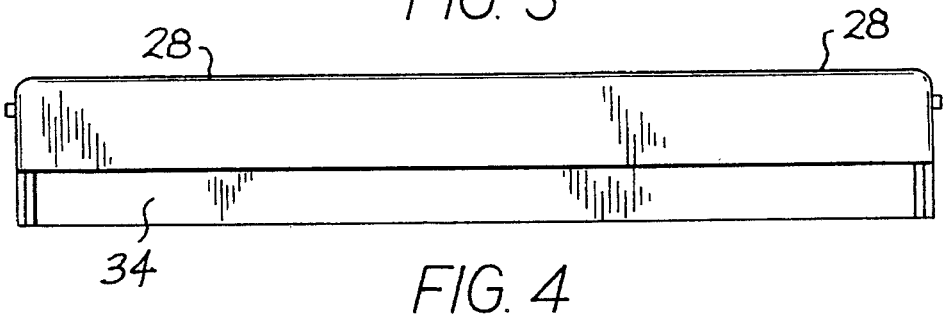
FIG. 4 is a rear view of the putting game device of FIG. 1.
Figure 6:
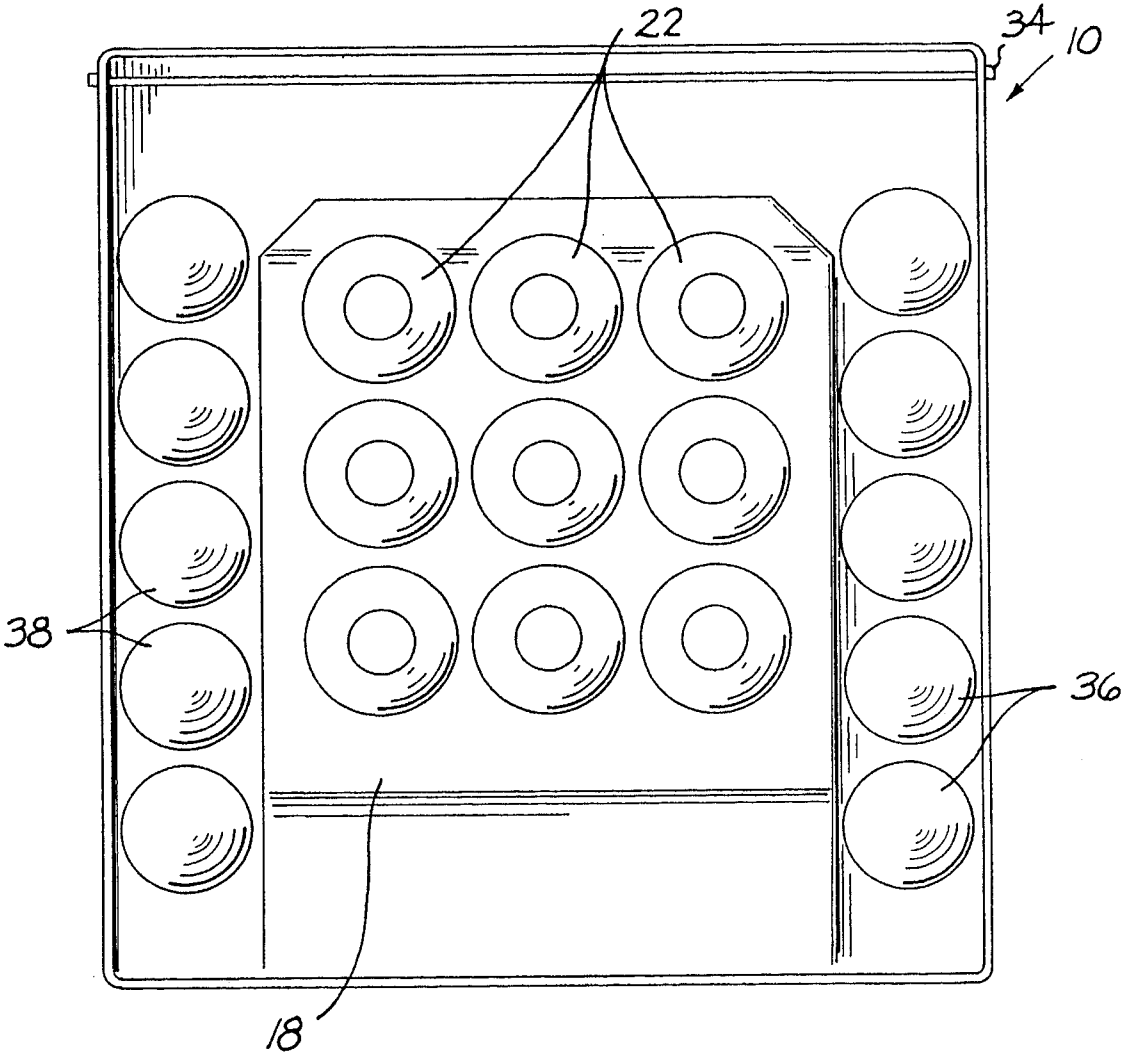
FIG. 6 as a bottom view of the putting game device of FIG. 1.
Figure 5:
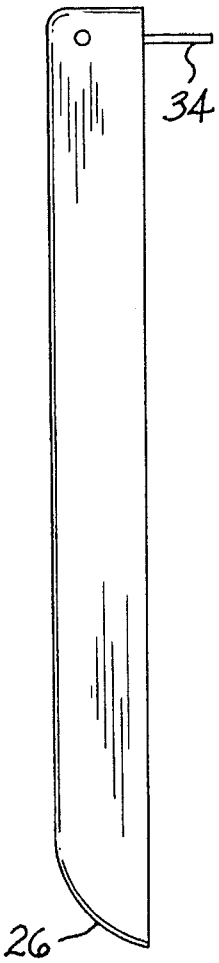
FIG. 5 is a right side view of the putting game device of FIG. 1, which is a mirror image of the left side.
Figure 7:
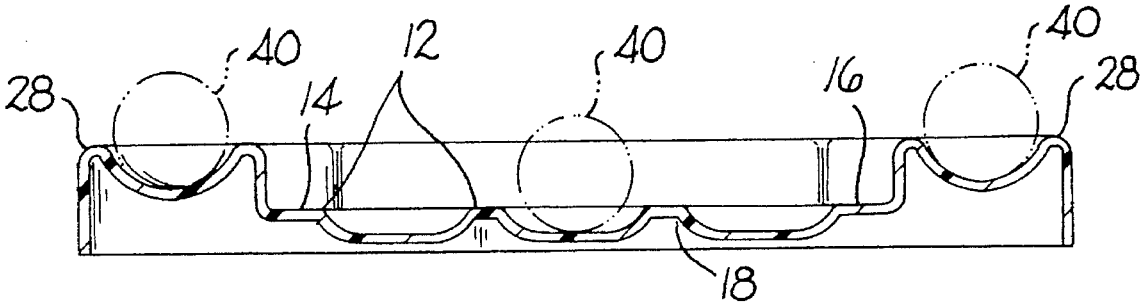
FIG. 7 is a front sectional view taken along the section 7—7 of FIG. 2, with golf balls shown in phantom.
Figure 8:
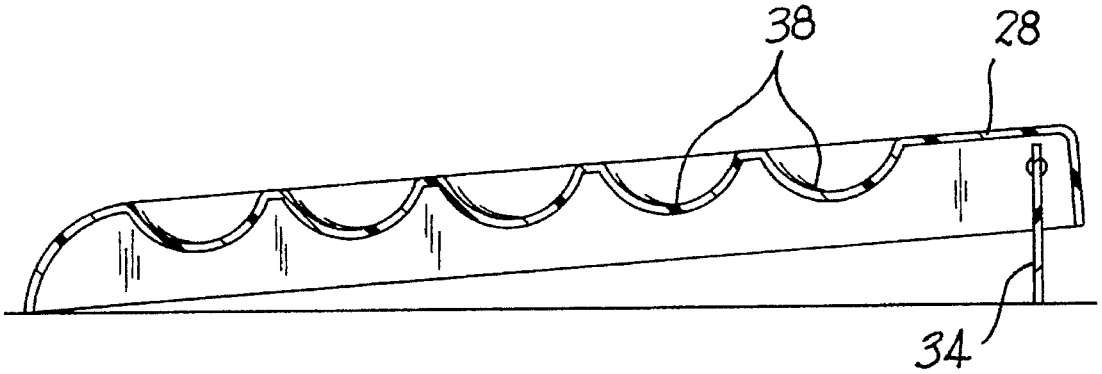
FIG. 8 is a side sectional view taken along the section 8—8 of FIG. 2.
Figure 9:
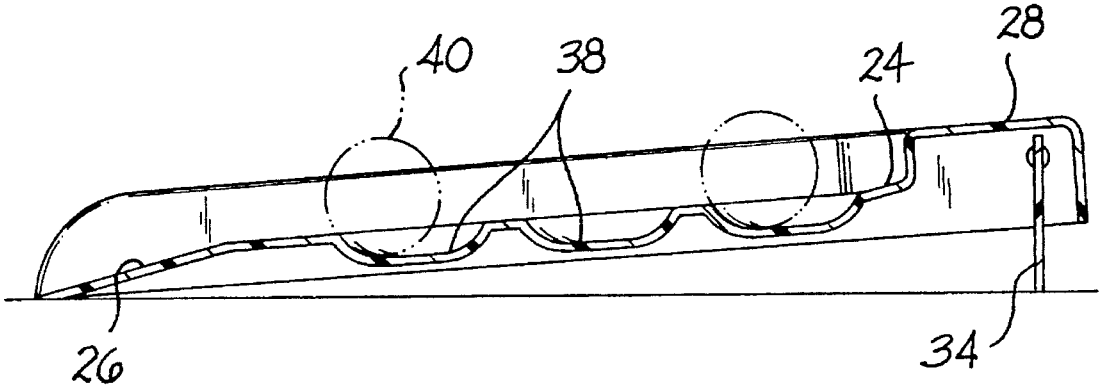
FIG. 9 is a side sectional view taken along the section 9—9 of FIG. 2, with golf balls shown in phantom.

The putting game board 10 has a top playing surface 12, which includes a front side 18, a left side 14, a rear side 20, and a right side 16. A ramp 26 leads from floor level up to the front side 18 of the playing surface 12. The top playing surface 12 has nine indentations 22 to simulate a tic-tac-toe board, with lines 42 drawn in a grid about the indentations 22 (three parallel rows of three). There is a raised frame 28 around the left, right and rear sides 14, 16, 20 of the playing surface 12. The raised frame 28 has left and right rows of indentations 36, 38 to hold the golf balls 40 to be used for playing the game.

The preferred embodiment of the game board 10 is made from molded plastic. The indentations 36 on the left side of the raised frame 28 are labelled "X" and the indentations 38 on the right side of the raised frame 28 are labelled "O". Each player has a plurality of golf balls 40 with some kind of distinguishing markings to distinguish the "X" balls from the "O" balls. The distinguishing marking may be "X" and "O" labels on the balls, or different colored balls, or any other indicia. The players then take turns putting their golf balls 40 from the floor, up the ramp 26, and onto the top playing surface 12, trying to get their golf balls 40 into the indentations 22 on the top playing surface 12. The game proceeds with the players alternating hitting the golf balls 40 onto the top playing surface 12. The game may include bumping a golf ball out of its indentation by hitting it with another golf ball. The first player to get three of his own golf balls 40 in a row wins the game.

The degree of difficulty can be increased by pivoting the movable rear leg 34 to an extended position to elevate the rear side 20 of the playing surface 12. The movable rear leg 34 can be folded flat or retracted for storage or to decrease the difficulty level of the game. Alternatively, the board 10 may simply be molded with a fixed elevation so that, for example, the rear side 20 of the playing surface is one inch higher than the front side 18, in which case the rear leg 34 can be eliminated. The raised frame 28 provides flat surfaces 30, 32 at the corners where the left and rear sides 14, 20 intersect and where the right and rear sides 16, 20 intersect to prevent a ball from getting stuck in a corner. Also, beginning approximately one inch in from the rear side 20 of the playing surface 12, the playing surface 12 has an increased sloping portion 24 which ensures that any golf ball 40 reaching the back sloped portion 24 will roll back down again preventing the golf balls 40 from resting in a dead space in the rear of the playing surface 12.

It will be obvious to those skilled in the art that modifications may be made to the embodiment described above without departing from the scope of the present invention.

What is claimed is:

1. A game board for a golf putting game to be played on the floor, comprising:

a playing surface having left, right, front and rear sides and including a plurality of indentations for receiving golf balls;

a ramp leading downward from the front side to engage the floor a raised frame around the left, right and rear sides, said raised frame having a top surface;

said raised frame including indentations in its top surface for holding golf balls to be used in the game.

2. A game board as recited in claim 1, wherein said raised frame defines flat surfaces at the intersection of the left and rear sides of the playing surface and at the intersection of the right and rear sides of the playing surface to prevent balls from getting stuck at the corners of the playing surface.

3. A game board as recited in claim 1, and further comprising a movable rear leg on said frame which can be extended to raise the rear of the game board up off the floor and can be retracted for storing the game board.

4. A game board as recited in claim 1, wherein said last named indentations lie in two rows, one row to the left of the playing surface and the other row to the right of the playing surface.

5. A game board as recited in claim 4, wherein one of said rows is labelled "X", and the other side is labelled "O".

6. A game board as recited in claim 4, and further comprising two sets of golf balls being received in their respective rows of indentations, each set of golf balls having some identifying marking so as to be able to distinguish the two sets from each other.

* * * * *